US006658891B2

(12) United States Patent
Reijnen et al.

(10) Patent No.: US 6,658,891 B2
(45) Date of Patent: Dec. 9, 2003

(54) OFFSHORE PLANT FOR LIQUEFYING NATURAL GAS

(75) Inventors: Duncan Peter Michael Reijnen, Rijswijk (NL); David Bertil Runbalk, The Hague (NL)

(73) Assignee: Shell Research Limited, London (GB)

( * ) Notice: Subject to any disclaimer, the term of this patent is extended or adjusted under 35 U.S.C. 154(b) by 0 days.

(21) Appl. No.: 10/148,640

(22) PCT Filed: Nov. 29, 2000

(86) PCT No.: PCT/EP00/12027

§ 371 (c)(1),
(2), (4) Date: Jun. 3, 2002

(87) PCT Pub. No.: WO01/40725

PCT Pub. Date: Jun. 7, 2001

(65) Prior Publication Data

US 2002/0170312 A1 Nov. 21, 2002

(30) Foreign Application Priority Data

Dec. 1, 1999 (EP) ..... 99204067

(51) Int. Cl.[7] ..... F25J 1/00
(52) U.S. Cl. ..... 62/612
(58) Field of Search ..... 62/611, 612, 335

(56) References Cited

U.S. PATENT DOCUMENTS 4,359,871 A 11/1982 Strass
4,525,185 A * 6/1985 Newton ..... 62/612
4,566,885 A 1/1986 Haak
4,755,200 A * 7/1988 Liu et al. ..... 62/612
5,265,434 A * 11/1993 Alsenz ..... 62/117
5,473,900 A * 12/1995 Low ..... 62/611
5,613,373 A * 3/1997 Grenier ..... 62/612
5,689,141 A * 11/1997 Kikkawa et al. ..... 290/52
5,791,159 A * 8/1998 Aicher et al. ..... 62/510
5,806,341 A * 9/1998 Rathbone ..... 62/646
5,970,728 A * 10/1999 Hebert ..... 62/160

FOREIGN PATENT DOCUMENTS

WO 97 33131 9/1997 ..... F25J/1/02
WO WO-98/01335 * 1/1998
WO 98 01335 1/1998 ..... B63B/35/44
WO 99 30094 6/1999 ..... F25J/1/02

OTHER PUBLICATIONS

"La Liquefaction Des Gaz Associes," by Henri Paradowski and Oronzo Sguera, Session II, Paper 9.

* cited by examiner

*Primary Examiner*—William C. Doerrler

(57) ABSTRACT

Plant for liquefying natural gas comprising a main heat exchanger in which the natural gas is liquefied by means of indirect heat exchange with evaporating refrigerant, and a refrigerant circuit in which evaporated refrigerant is compressed and liquefied to produce liquid refrigerant that is used in the main heat exchanger, wherein the refrigerant circuit includes a compressor train consisting of at least one compressor driven by an electric motor.

5 Claims, 2 Drawing Sheets

OFFSHORE PLANT FOR LIQUEFYING NATURAL GAS

BACKGROUND OF THE INVENTION

The present invention relates to a plant for liquefying natural gas.

FIELD OF THE INVENTION

A plant for liquefying natural gas comprises a main heat exchanger in which the natural gas is liquefied by means of indirect heat exchange with evaporating refrigerant, and a refrigerant circuit in which evaporated refrigerant is compressed and liquefied to produce liquid refrigerant that is used in the main heat exchanger. The refrigerant circuit includes a compressor train consisting of at least one compressor. The at least one compressor is driven by means of a gas turbine that is directly connected to the shaft of the compressor. Such a plant is disclosed in U.S. Pat. No. 5,689,141. Because a gas turbine has only a limited operating window, the gas turbine is first selected and the liquefaction plant is so designed that the gas turbine operates in its limited operating window. In addition the gas turbine and the compressor are directly connected to each other, so that they form a single unit. The single unit occupies a considerable surface area.

There is a tendency to look for ways of reducing the surface area of such a liquefaction plant. This does not only apply to on-shore plants, but also to floating liquefaction plants.

Such floating liquefaction plants are used in the development of off-shore gas fields, where the gas is liquefied near the production location. Thereto the liquefaction plant is installed on a barge that serves as a floating storage of liquefied natural gas. The barge is furthermore provided with an off-loading system to transfer the liquefied natural gas into a tanker, and with a gas loading system that is connected by means of a swivel to the upper end of a riser pipe, wherein the lower end of the riser pipe is connected to a well producing natural gas.

SUMMARY OF THE INVENTION

It is an object of the present invention to provide a plant for liquefying natural gas that is flexible and that occupies a small surface area, so that, for example a barge can accommodate the liquefaction plant.

To this end, the plant for liquefying natural gas according to the present invention comprises a main heat exchanger in which natural gas is liquefied by means of indirect heat exchange with evaporating refrigerant, and a refrigerant circuit in which evaporated refrigerant is compressed and liquefied to produce liquid refrigerant that is used in the main heat exchanger, wherein the refrigerant circuit includes a compressor train consisting of at least one compressor driven by an electric motor.

It will be understood that there should be provided an electric power plant to provide electric energy to drive the electric motors. The electric power plant will include one or more gas or steam turbines each driving an electric generator. With the liquefaction plant according to the present invention, the gas or steam turbine(s) can be put everywhere where for reasons of lay-out planning or for reasons of safety they are best located.

BRIEF DESCRIPTION OF THE FIGURES

The invention will now be described by way of example with reference to the accompanying drawings, wherein.

DETAILED DESCRIPTION OF THE INVENTION

Figure 1:
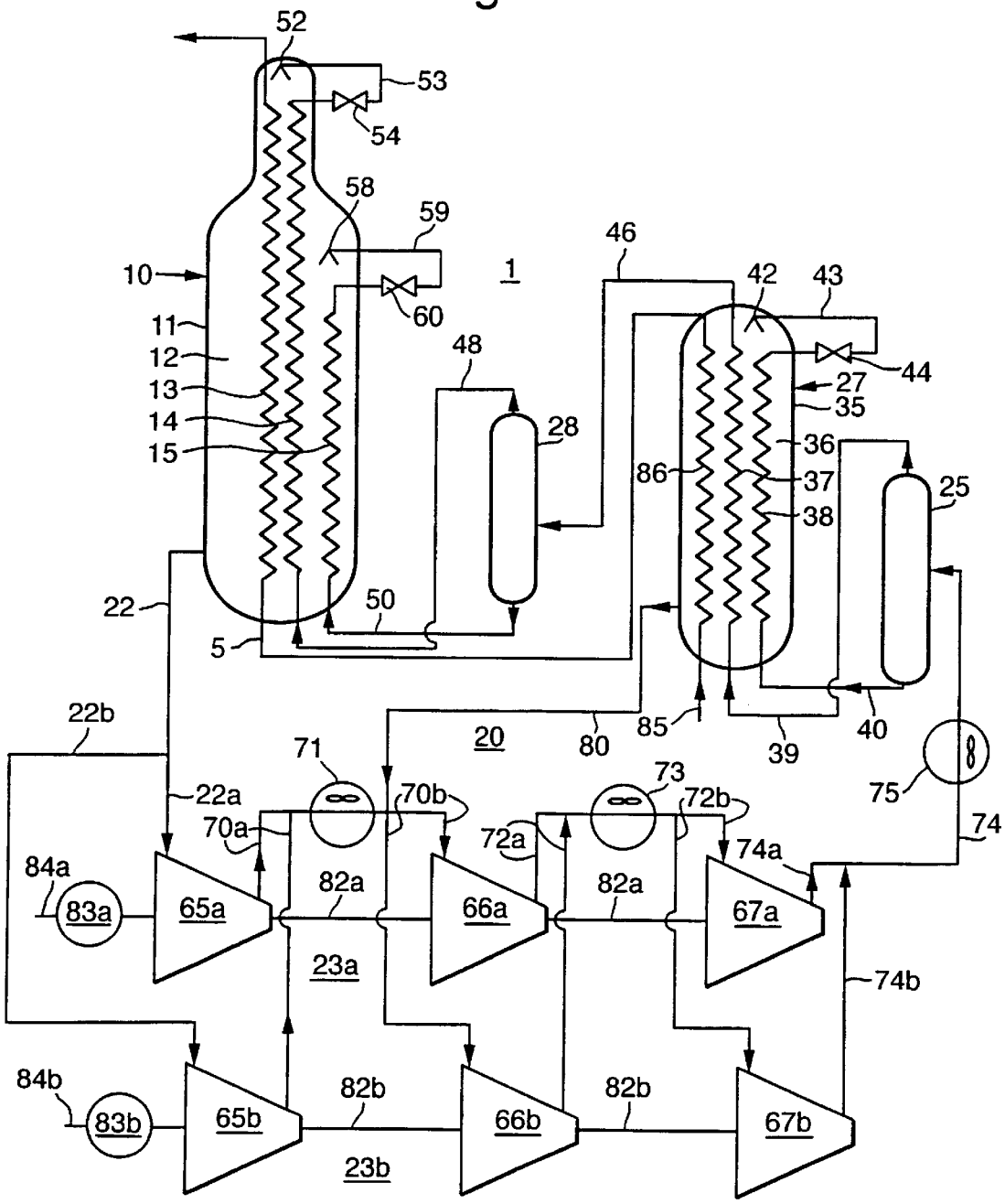
FIG. 1 shows schematically a first embodiment of the invention.

Reference is now made to FIG. 1. The plant 1 for liquefying natural gas supplied through conduit 5 comprises a main heat exchanger 10, having a shell 11 enclosing a shell side 12 in which three heat exchanger tubes 13, 14 and 15 are arranged. In the main heat exchanger 10 the natural gas is liquefied by means of indirect heat exchange with refrigerant evaporating in the shell side 12.

The plant 1 also comprises a refrigerant circuit 20. The refrigerant circuit 20 comprises the shell side 12 of the main heat exchanger 10, conduit 22, a first and a second compressor train 23*a* and 23*b* arranged in parallel, a gas-liquid separator 25, a pre-cooler heat exchanger 27, a main gas-liquid separator 28 and the second and the third heat exchanger tubes 14 and 15 in the main heat exchanger 10.

Before discussing the compressor trains 23*a* and 23*b* in more detail, the remainder of the refrigerant circuit 20 is discussed. The pre-cooler heat exchanger 27 has a shell 35 enclosing a shell side 36 in which two heat exchanger tubes 37 and 38 are arranged, which pertain to the refrigerant circuit 20. The inlet end of heat exchanger tube 37 is connected by means of conduit 39 to the outlet for gas of the gas-liquid separator 25, and the inlet end of heat exchanger tube 38 is connected by means of conduit 40 to the outlet for liquid of the gas-liquid separator 25. The discharge end of the heat exchanger tube 38 is connected to a nozzle 42 arranged in the shell side 36 by means of a conduit 43 provided with an expansion device 44. The discharge end of the heat exchanger tube 37 is connected by means of conduit 46 to the inlet of the main gas-liquid separator 28. The outlet for gas of the main gas-liquid separator 28 is connected by means of conduit 48 to the inlet of the heat exchanger tube 14, and the outlet for liquid is connected by means of conduit 50 to the heat exchanger tube 15 in the main heat exchanger 10. The discharge end of the heat exchanger tube 14 is connected to a nozzle 52 arranged in the shell side 12 by means of a conduit 53 provided with an expansion device 54, and the discharge end of the heat exchanger tube 15 is connected to a nozzle 58 arranged in the shell side 12 by means of a conduit 59 provided with an expansion device 60.

Now the parallel compressor trains will be discussed in more detail. Each of the compressor trains 23*a* and 23*b* consists of three interconnected compressors, a low pressure compressor 65*a*, 65*b*, an intermediate pressure compressor 66*a*, 66*b* and a high pressure compressor 67*a*, 67*b*. Conduit 22 is connected to the inlets of the low pressure compressors 65*a* and 65*b* by means of conduits 22*a* and 22*b*. The outlets of the low pressure compressors 65*a*, 65*b* are connected to the inlets of the intermediate pressure compressors 66*a*, 66*b* by means of conduits 70*a* and 70*b*, provided with an air cooler 71. The outlets of the intermediate pressure compressors 66*a*, 66*b* are connected to the inlets of the high pressure compressors 67*a*, 67*b* by means of conduits 72*a* and 72*b*, provided with an air cooler 73. The outlets of the high pressure compressors 67*a*, 67*b* are connected to the inlet of the gas-liquid separator 25 by means of conduits 74, 74*a* and 74*b*, provided with an air cooler 75.

The shell side 36 of the pre-cooler heat exchanger 27 is connected to the inlets of the intermediate pressure compressors 66*a*, 66*b* by means of conduit 80.

The compressors of each compressor train 23*a* or 23*b* are arranged on the same shaft 82*a* or 82*b* driven only by an electric motor 83*a* or 83*b*. The electric motors 83*a* and 83*b* are connected to an electric generator (not shown) by means of electric conduits 84*a* and 84*b*.

During normal operation natural gas supplied through conduit 5 is passed through heat exchanger tube 13 arranged in the shell side 12 of the main heat exchanger 10, and liquefied natural gas is removed from the discharge end of the heat exchanger tube 13. Evaporated refrigerant is removed from the shell side 12, and it is passed through conduits 22, 22*a*, 22*b* to the inlets of the low pressure compressors 65*a*, 65*b* of the parallel compressor trains 23*a* and 23*b*, in such a way that substantially equal amounts of refrigerant are supplied to the compressor trains 23*a* and 23*b*. In the compressors 65*a*, 65*b*, 66*a*, 66*b*, 67*a*, 67*b* the refrigerant is compressed from a low pressure in stages to a high pressure, and in between the heat of compression is removed in the air coolers 71 and 73.

At the high pressure the refrigerant is supplied to the air cooler 75 in which it is partly liquefied. The partly liquefied stream of refrigerant is separated into a gaseous stream and a liquid stream in the gas-liquid separator 25.

The liquid stream is used for autorefrigeration and for partly liquefying the gaseous refrigerant stream. To this end the liquid stream is passed at high pressure through heat exchanger tube 38 and expanded in expansion device 44. In expanded form the liquid stream is introduced in the shell side 36 through nozzle 42. The gaseous stream is partly liquefied in the heat exchanger tube 37, and passed to the main gas-liquid separator 28.

In the main gas-liquid separator 28, this stream is separated into a gaseous stream and a liquid stream, which are both used for autorefrigeration and for liquefying the natural gas stream in the main heat exchanger 10.

To this end the liquid stream is passed at high pressure through heat exchanger tube 15 and expanded in expansion device 60. In expanded form the liquid stream is introduced through nozzle 58 in the shell side 12, where it is allowed to evaporate at low pressure. The gaseous stream is passed at high pressure through heat exchanger tube 14, wherein it is partly liquefied, and this partly liquefied stream is subsequently expanded in expansion device 54 and introduced in the shell side 12 through nozzle 52, where it is allowed to evaporate at low pressure.

In the main heat exchanger 10, the natural gas stream 5 is liquefied and sub-cooled while passing through the heat exchanger tube 13 by indirect heat exchange with the expanded streams that are introduced into the shell side 12 through nozzles 52 and 58.

Preferably, natural gas is pre-cooled, and to this end, it is supplied via conduit 85 to the inlet end of a heat exchanger tube 86 in the pre-cooler heat exchanger 27. The outlet end of the heat exchanger tube 86 is connected to conduit 5.

Figure 2:
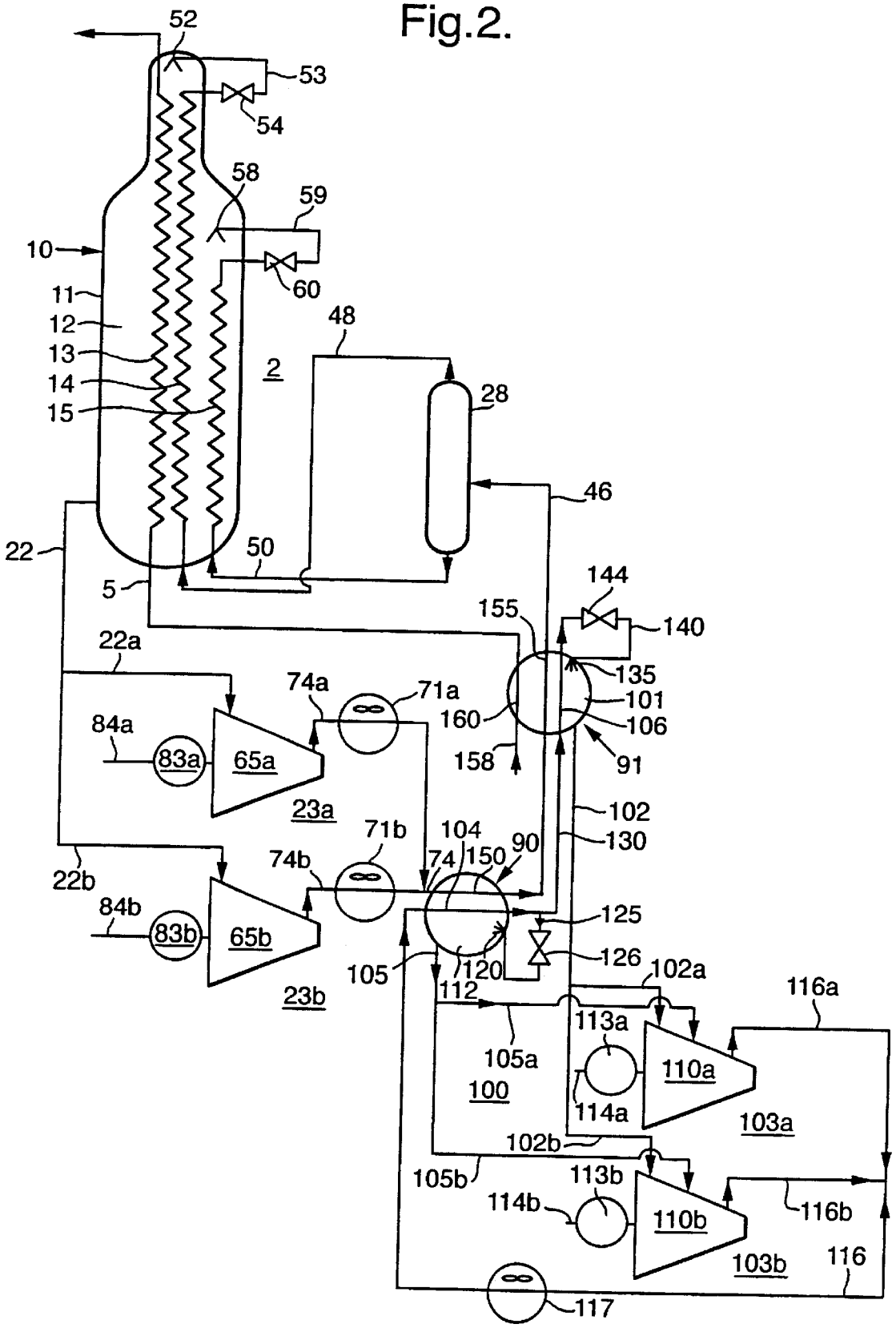
FIG. 2 shows schematically a second embodiment of the invention.

Reference is now made to FIG. 2, showing schematically an alternative embodiment of the invention. Parts that are similar to parts discussed with reference to FIG. 1 have been referred to with the same reference numerals. The plant 2 of FIG. 2 differs from the plant 1 shown in FIG. 1 in that the refrigerant circuit 20 includes auxiliary heat exchangers 90 and 91. In auxiliary heat exchangers 90 and 91 the refrigerant is partly liquefied by indirect heat exchange with auxiliary refrigerant. The auxiliary heat exchangers 90 and 91 also form part of the auxiliary refrigerant circuit 100. The auxiliary heat exchangers 90 and 91 take the place of the air cooler 75 and the pre-cooler heat exchanger 27 as shown in FIG. 1. In addition each of the first and the second compressor trains 23*a* and 23*b* consists of a single compressor 65*a* and 65*b*.

Now the auxiliary refrigerant circuit 100 of the plant 2 will be discussed. The auxiliary refrigerant circuit 100 comprises shell side 101 of the auxiliary heat exchanger 91, conduit 102, a first and a second auxiliary compressor train 103*a* and 103*b* arranged in parallel, a heat exchanger tube 104 arranged in the auxiliary heat exchanger 90, and a heat exchanger tube 106 in the auxiliary heat exchanger 91.

The auxiliary compressor trains 103*a* and 103*b* consist of two-stage compressors 110*a* and 110*b*, which are arranged to receive two streams of evaporated auxiliary refrigerant from the shell side 101 of the auxiliary heat exchanger 91 through conduits 102, 102*a*, 102*b*, and from shell side 112 of the auxiliary heat exchanger 90 through conduits 105, 105*a* and 105*b*. The compressors 110*a* and 110*b* are driven only by an auxiliary electric motor 113*a* or 113*b*. The auxiliary electric motors 113*a* and 113*b* are connected to an electric generator (not shown) by means of electric conduits 114*a*, 114*b*.

The outlets of the two-stage compressors 110*a* and 110*b* are connected to the inlet of the heat exchanger tube 104 of the auxiliary heat exchanger 90 by means of conduits 116*a*, 116*b*, 116, provided with air cooler 117. The discharge end of the heat exchanger tube 104 is connected to a nozzle 120 arranged in the shell side 112 by means of a conduit 125 provided with an expansion device 126 to supply during normal operation part of the auxiliary refrigerant to the shell side 112. The remainder is passed through conduit 130, which is connected to the inlet end of the heat exchanger tube 106 in the auxiliary heat exchanger 91. The discharge end of the heat exchanger tube 106 is connected to a nozzle 135 arranged in the shell side 101 by means of a conduit 140 provided with an expansion device 144.

During normal operation natural gas supplied through conduit 5 is passed through heat exchanger tube 13 arranged in the shell side 12 of the main heat exchanger 10, and liquefied natural gas is removed from the discharge end of the heat exchanger tube 13.

Evaporated refrigerant is removed from the shell side 12, and it is passed through conduits 22, 22*a*, 22*b* to the inlets of the parallel compressor trains 23*a* and 23*b*, in such a way that substantially equal amounts of refrigerant are supplied to the compressor trains 23*a* and 23*b*. The heat of compression is removed in the air coolers 71*a* and 71*b*. The refrigerant is passed on through the conduit 74 to heat exchanger tube 150 in the auxiliary heat exchanger 90 and subsequently to heat exchanger tube 155 in the auxiliary heat exchanger 91, and during this passage the refrigerant is partly liquefied by indirect heat exchange with evaporating auxiliary refrigerant.

From the discharge end of the heat exchanger tube 155 partly liquefied refrigerant is passed through conduit 46 to the main gas-liquid separator 28. In the main gas-liquid separator 28, this is separated into a gaseous stream and a liquid stream, which are both used for autorefrigeration and for liquefying the natural gas stream in the main heat exchanger 10.

To this end the liquid stream is passed at high pressure through heat exchanger tube 15 and expanded in expansion device 60. In expanded form the liquid stream is introduced in the shell side 12 through nozzle 58. The gaseous stream is passed at high pressure through heat exchanger tube 14, wherein it is partly liquefied, and this partly liquefied stream is subsequently expanded in expansion device 54 and introduced in the shell side 12 through nozzle 52.

As stated before, in order to partly liquefy the refrigerant, auxiliary refrigerant is passed through the auxiliary refrigerant circuit 100 in the following way.

Evaporated auxiliary refrigerant is removed from the shell side 101 of the auxiliary heat exchanger 91, and it is passed through conduits 102, 102*a*, 102*b* to the inlets of the parallel auxiliary compressors 110*a* and 110*b*, in such a way that during normal operation substantially equal amounts of auxiliary refrigerant are supplied to the compressors 110*a* and 110*b*. In the compressors 110*a* and 110*b* the auxiliary refrigerant is compressed to high pressure. Heat of compression is removed from the compressed auxiliary refrigerant by means of air cooler 117.

Auxiliary refrigerant at high pressure is passed through the heat exchanger tube 104 in the auxiliary heat exchanger 90, and part of the cooled auxiliary refrigerant is passed through expansion device 126 to the shell side 112 where it is allowed to evaporate at an intermediate pressure. Thus cooling the auxiliary refrigerant by autorefrigeration and cooling the refrigerant passing through heat exchanger tube 150. The remainder is supplied at high pressure to the heat exchanger tube 106 in the auxiliary heat exchanger 91. Cooled auxiliary refrigerant leaving the heat exchanger tube 106 is passed through expansion device 144 to the shell side 101 of the auxiliary heat exchanger 91, where it is allowed to evaporate at a low pressure.

Auxiliary refrigerant at the intermediate pressure is removed from the shell side 112 of the auxiliary heat exchanger 90 via conduits 105, 105*a* and 105*b* to the inlets of the second stage of the two-stage compressors 110*a* and 110*b*, whereas auxiliary refrigerant at the low pressure is removed from the shell side 101 of the auxiliary heat exchanger 91 via conduits 102, 102*a* and 102*b* to the inlets of the first stage of the two-stage compressors 110*a* and 110*b*.

Preferably, natural gas is pre-cooled, and to this end, it is supplied via conduit 158 to the inlet end of a heat exchanger tube 160 in the auxiliary heat exchanger 91. The outlet end of the heat exchanger tube 160 is connected to conduit 5.

The operating conditions of the liquefaction plants as described with reference to the Figures and the compositions of the refrigerants are well known, and will not be discussed here.

An advantage of the plant as discussed with reference to FIG. 2 is that the power supplied to the electric motors 83*a* and 83*b* and the electric motors 113*a* and 113*b* can be selected to match the cooling requirements in the refrigeration circuits 20 and 100.

The parallel arrangement of the compressor trains is preferred because in the event of a failure in or maintenance of one compressor train the other one can continue to operate, so that the plant can continue to liquefy natural gas.

Each of the three separate compressors of the compressor trains 23*a* and 23*b* can be replaced by a single three-stage compressor.

It will be understood that air coolers can be replaced by water coolers.

The electric generators providing the electric power driving the electric motors 83*a*, 83*b*, 113*a* and 113*b* and the required drivers (steam or gas turbines) can be arranged at the most suitable location. They not be arranged in-line with the compressors, and therefore the present invention provides a plant for liquefying natural gas that is flexible and that occupies only a relatively small surface area, so that, for example a barge can accommodate the liquefaction plant.

What is claimed is:

1. A plant for liquefying natural gas comprising a main heat exchanger in which natural gas is liquefied by means of indirect heat exchange with evaporating refrigerant, and a refrigerant circuit in which evaporated refrigerant is compressed and liquefied to produce a liquid refrigerant that is used in the main heat exchanger, wherein the refrigerant circuit includes a compressor train consisting of at least one compressor driven only by an electric motor.

2. The plant according to claim 1, wherein the refrigerant circuit includes two parallel compressor trains, each consisting of at least one compressor driven by an electric motor.

3. The plant according to claim 1, wherein the refrigerant circuit includes means to at least partly liquefy the refrigerant by autorefrigeration.

4. The plant according to claim 1, wherein the refrigerant circuit includes an auxiliary heat exchanger to partly liquefy the refrigerant by indirect heat exchange with evaporating auxiliary refrigerant, which plant further includes an auxiliary refrigerant circuit and means to liquefy the auxiliary refrigerant by autorefrigeration, in which evaporated auxiliary refrigerant is compressed and liquefied to produce liquid auxiliary refrigerant that is used in the auxiliary heat exchanger, wherein the auxiliary refrigerant circuit includes an auxiliary compressor train consisting of at least one compressor driven by an electric motor.

5. The plant according to claim 4, wherein the auxiliary refrigerant circuit includes two parallel auxiliary compressor trains, each consisting of at least one compressor driven by an electric motor.

* * * * *